US006891559B1

(12) United States Patent
Bannai

(10) Patent No.: US 6,891,559 B1
(45) Date of Patent: May 10, 2005

(54) OPTICAL SCANNING APPARATUS AND AN IMAGE FORMING APPARATUS

(75) Inventor: Kazunori Bannai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 913 days.

(21) Appl. No.: 09/691,035

(22) Filed: Oct. 19, 2000

(30) Foreign Application Priority Data

Oct. 19, 1999 (JP) ..... P11-296127

(51) Int. Cl.[7] ..... B41J 2/435
(52) U.S. Cl. ..... 347/245; 347/263
(58) Field of Search ..... 347/238, 242, 347/245, 257, 263, 241, 256; 372/72; 362/259; 428/35.7

(56) References Cited

U.S. PATENT DOCUMENTS

| | | | | | |
|---|---|---|---|---|---|
| 4,800,401 | A | * | 1/1989 | Sato et al. | 347/242 |
| 4,835,786 | A | * | 5/1989 | Morris et al. | 372/72 |
| 5,219,154 | A | | 6/1993 | Fukube et al. | 271/18.2 |
| 5,224,693 | A | | 7/1993 | Taguchi et al. | 271/9.11 |
| 5,227,842 | A | | 7/1993 | Hayashi et al. | 399/55 |
| 5,255,904 | A | | 10/1993 | Taguchi et al. | 271/18.1 |
| 5,270,783 | A | | 12/1993 | Bisaiji et al. | 399/62 |
| 5,297,376 | A | | 3/1994 | Taguchi et al. | 53/504 |
| 5,315,322 | A | | 5/1994 | Bannai | 347/134 |
| 5,316,282 | A | | 5/1994 | Fukube et al. | 271/10.07 |
| 5,325,213 | A | | 6/1994 | Takahashi et al. | 358/474 |
| 5,390,033 | A | | 2/1995 | Bannai et al. | 358/498 |
| 5,471,277 | A | | 11/1995 | Fujioka et al. | 355/25 |
| 5,583,607 | A | | 12/1996 | Fujioka et al. | 355/25 |
| 5,583,662 | A | | 12/1996 | Takahashi et al. | 358/474 |
| 5,610,720 | A | | 3/1997 | Fujioka et al. | 358/296 |
| 5,682,227 | A | | 10/1997 | Taguchi et al. | |
| 5,689,348 | A | | 11/1997 | Takahashi et al. | 358/475 |
| 5,847,845 | A | | 12/1998 | Takahashi et al. | 358/475 |
| 5,997,153 | A | * | 12/1999 | Naoe et al. | 362/259 |
| 6,075,624 | A | | 6/2000 | Bannai et al. | 358/498 |
| 6,641,878 | B2 | * | 11/2003 | Suzuki et al. | 428/35.7 |

OTHER PUBLICATIONS

U.S. Appl. No. 09/691,035, filed Oct. 19, 2000, Bannai.
U.S. Appl. No. 10/805,235, filed Mar. 22, 2004, Bannai et al.

* cited by examiner

*Primary Examiner*—Hai Pham
(74) *Attorney, Agent, or Firm*—Oblon, Spivak, McClelland, Maier & Neustadt, P.C.

(57) ABSTRACT

An optical scanning apparatus including a laser diode light source fittingly inserted into a holding member. The holding member is formed of a resin material having a thermal conductivity of 0.7 w/m°K or more and filled with either glass fiber or metal oxide or both, or aluminum. A heat radiating fin projecting radially is formed on an outer circumferential portion of the cylindrical body of the holding member. With this structure, temperature rise due to heat emission from the laser diode can be suppressed and deterioration of the laser diode can be prevented. This structure simply and inexpensively provides stable optical properties to optical scanning and image forming devices.

20 Claims, 5 Drawing Sheets

OPTICAL SCANNING APPARATUS AND AN IMAGE FORMING APPARATUS

CROSS REFERENCE TO RELATED APPLICATIONS

This application claims benefit of priority under 35 U.S.C. §120 to Japanese Patent Application No. JPAP 11-296127 filed in the Japanese Patent Office on Oct. 19, 1999, the entire contents of which are incorporated by reference herein.

BACKGROUND OF THF INVENTION

1. Field of the Invention

The present invention relates to an optical scanning apparatus employing a laser diode as a light source and an image forming apparatus employing such an optical scanning apparatus. The image forming apparatus may be used in digital copying machines, printers, facsimile devices, and other devices in which the image is formed by radiating a light laser beam onto a photosensitive body.

2. Discussion of the Background

Many image forming devices are provided for use in copying machines, printers, facsimiles, etc., in which a light beam output from a laser diode is radiated onto a photosensitive body, thereby forming an electrostatic latent image on the photosensitive body.

An example of such an image forming apparatus is found in the published specification of Japanese Laid-open Patent Publication No. 6-246974, which discloses the technology of measuring the temperature of a laser diode and compensating the optical output in accordance with the measured temperature, when the environmental temperature, etc., of the laser diode varies.

According to the above-mentioned Japanese Laid-open Patent Publication No. 6-246974, when the environmental temperature, etc., of the laser diode varies, the temperature of the laser diode is measured and the optical output is compensated in accordance with the measured temperature.

The above published specification further discloses that, when the temperature rises, the light emitting coefficient is lowered and the oscillation wavelength of the laser diode is increased. Furthermore, when the accumulative light emitting time is increased, light emitting efficiency is lowered. The operating temperature of the laser diode has to be equal to or lower than a certain temperature (preferably, below 60° C.). When the temperature exceeds the above-mentioned operating temperature, the laser diode breaks down.

Here, the actual temperature of a laser diode depends on the ambient temperature in the operating environment and the increase in temperature caused by heat emission of the laser diode itself. Regarding the amount of light emission from the laser diode itself, almost 95% of the input electric power is converted to thermal energy and the remaining part of the power is converted to laser light. In an image forming apparatus employing a laser diode, temperature near the optical scanning unit in the apparatus reaches almost 45° C. As a result, the increase in temperature caused by light emission from the laser diode itself is added to the temperature of the apparatus. For this reason, although it is not described in the above in specification, in the general prior art aluminum is used as the holding member for holding the laser diode. In such a structure, heat emission (radiation) is efficient.

The published specification discloses a method of holding the laser diode with a holding member made of metal material. The specification further discloses a fixing method for preventing the occurrence of the relative positional shift (difference) between the laser diode and a collimate lens caused by thermal expansion and contraction due to temperature variation.

Here, the laser diode performs heat emission at the time of emitting light where the amount of emitted heat corresponds to the thermal energy obtained by converting 95% of the input electric power to heat. Thus, light emission from a laser diode results in high-temperature heat emission. Laser diode functionality is considerably degraded and cannot be restored to its initial state when the temperature exceeds a certain temperature (e.g., 60° C.). For this reason, when a laser diode is used, it is generally required that the diode dissipate heat emitted from the laser diode itself A heat dissipating metal such as aluminum must be used, and therefore cost is inevitably increased.

On the other hand, in the recent years, in order to form an image with small pixel size and high pixel density (600 dpi or 1,200 dpi) in order to obtain a high-quality image, it is necessary to prepare an optical lens system for focusing laser diode light output onto a photosensitive body with a small spot diameter, and with high speed.

A method of enabling the output of an image with fine pixel density and high speed by constructing a light source with adjacently-arranged plural laser diodes and scanning the photosensitive body with plural light beam had been proposed previously. Another method uses a laser diode array (LDA) for outputting plural laser light beams. In this case, heat emission is greater than in the former method, and therefore, it is further important to effectively perform heat dissipation by the holding member of the laser diode.

On the other hand, in order to reduce the cost of the image forming apparatus, the cost of the respective parts has to be reduced. Therefore, it is desired to reduce the parts costs of the laser diode and the so-called LD holder for holding the laser diode.

SUMMARY OF THE INVENTION

The prior art, such as Japanese Laid-open Patent Publication Nos. 6-246974 and 9-193452, do not disclose effective ways for improving the above-mentioned optical 1 scanning apparatus and image forming apparatus employing such optical scanning apparatus.

The present invention has been made in view of the above-discussed and other problems and has solved the above-mentioned defects and troublesome matters of the background arts.

Accordingly, an object of the present invention is to provide novel optical scanning apparatus and image forming apparatus capable of preventing the temperature increase due to the heat emission from a laser diode, thereby preventing the deterioration of the laser diode.

According to a further aspect of the present invention, there is also provided a novel method for making an optical scanning apparatus and image forming apparatus capable of preventing the temperature increase due to laser diode heat emission, thereby preventing the deterioration of the laser diode.

Another object of the invention is to provide such devices with stable optical properties using a simple structure and at low cost.

These and other objects are achieved according to the present invention by providing novel heat dissipating structures which overcome the limitations of the prior art and provide for improved optical performance and high reliability.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
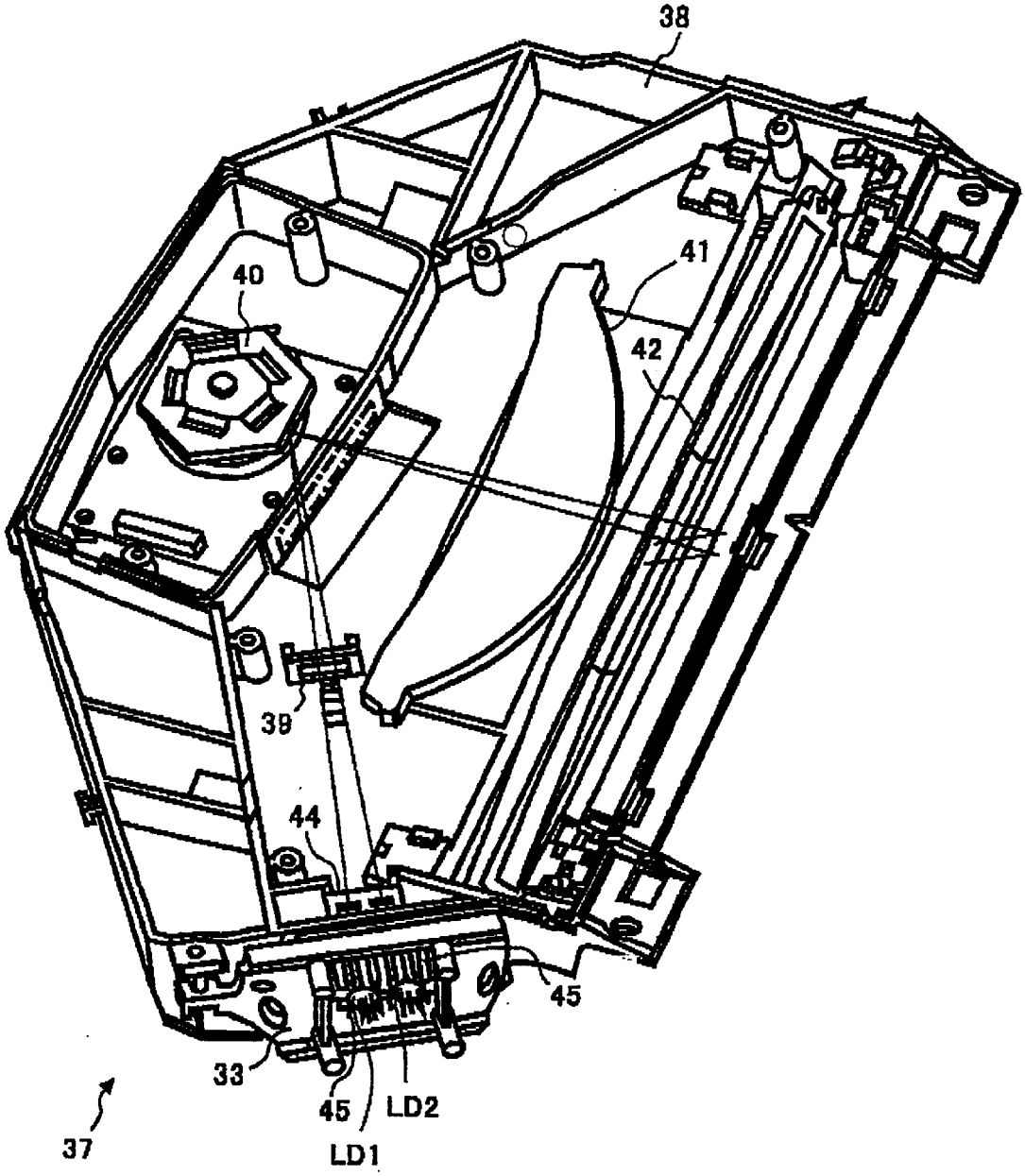
FIG. 1 is a perspective view illustrating the external appearance of an optical scanning apparatus according to the present invention.

In describing the preferred embodiment of the present invention illustrated in the accompanying drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views (graph, diagram), and more particularly to FIGS. 1 through 5, there are illustrated the optical scanning apparatus and the image forming apparatus according to the present invention.

Other features if the invention will become apparent in the course of the following descriptions of exemplary embodiments which are given for illustration of the invention and are not intended to be limiting thereof.

In order to attain the aforementioned objects of the present invention, the following structures are adopted in the invention.

(1) In the optical scanning apparatus for performing the optical scanning by use of the fight source, that is, the laser diode emitting the light beam, the laser diode is fittedly inserted into and held by a holding member, and the holding member is formed with the resin having the thermal conductivity of 0.7 w/m°K or more.

(2) In the optical scanning apparatus as described in (1), the apparatus has the holding member and the image focusing system on the base portion thereof.

(3) In the optical scanning apparatus as described in (1) or (2), the resin material filled with either one of the glass fiber and the metal oxide or both of them is employed as the holding member.

(4) In the optical scanning apparatus as described in (1) or (2), the glass fiber reinforced unsaturated polyester resin made by filling the unsaturated polyester resin with the glass fiber is employed as the holding member.

(5) In the optical scanning apparatus as described in (1), (2), (3), or (4), a heat radiating fin projecting radially is formed on the outer circumferential portion of the cylindrical holding member.

(6) The image forming apparatus including the charging unit (charger), the developing unit, and the transferring unit further includes the optical scanning apparatus as described in (1).

(7) In the optical scanning apparatus as described in (I) or (2), the resin material filled with aluminum is employed as the holding member.

An example of image forming apparatus according to the present invention is described hereinafter.

Figure 5:
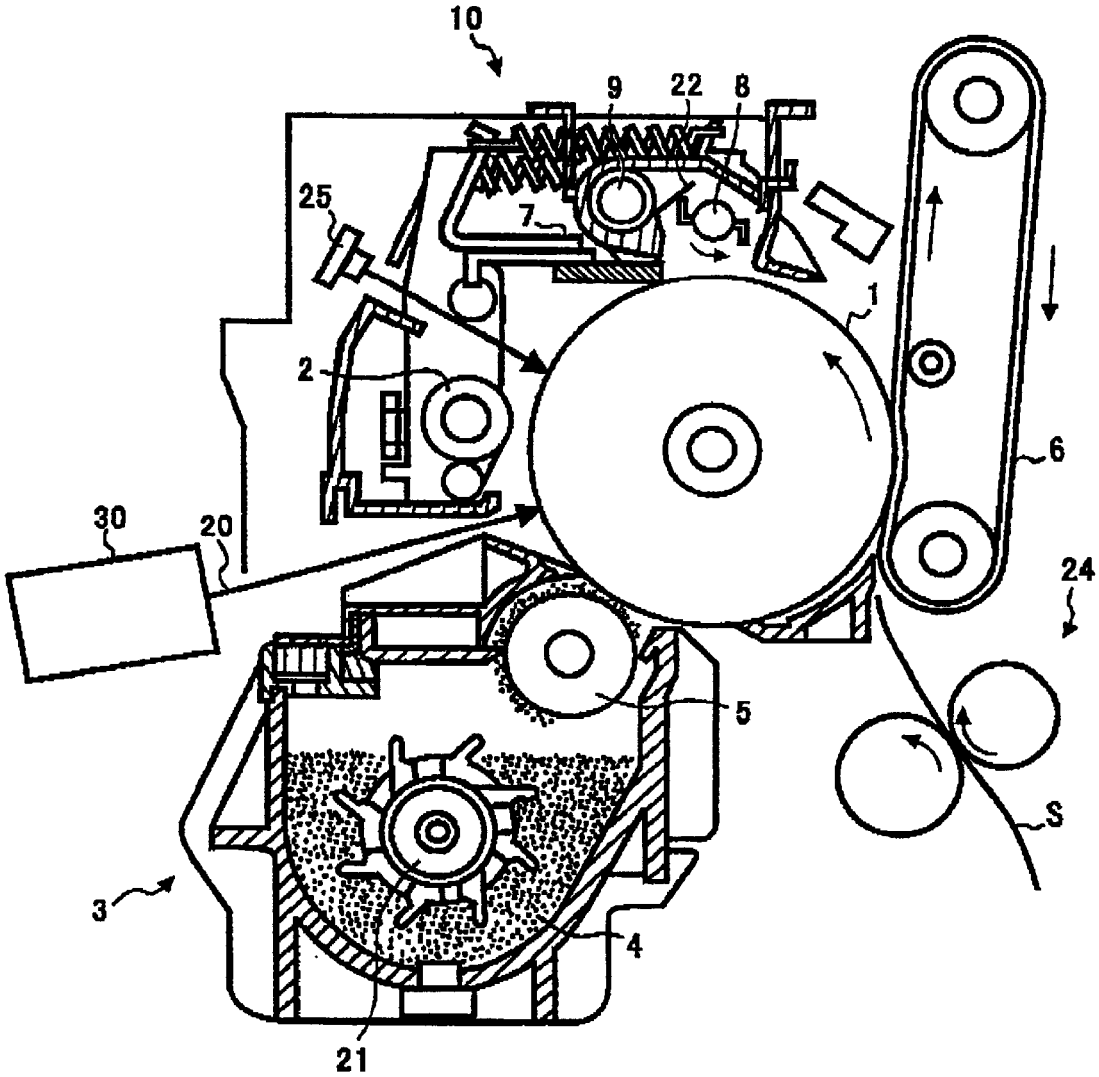
FIG. 5 is an explanatory diagram for explaining the main structure of the image forming apparatus employing the optical scanning apparatus according to the present invention.

Referring to FIG. 5, the structure and function of the main part of the image forming apparatus applied to the invention is explained. Next, the structure and function of the invention is explained. FIG. 5 illustrates the structure around the photosensitive body commonly used in the digital copying machine, the printer, and the facsimile device, etc., all for forming an image by scanning the photosensitive body with the light beam.

In FIG. 5, a charging roller 2 serving as the contact-type charging member is brought into contact with the circumferential portion of the drum-shaped photosensitive body 1, and the roller is rotated together with the photosensitive body 1 rotating in the direction as shown by an arrow. When the image is formed, the photosensitive body 1 rotates in the direction shown by the arrow. During the rotation thereof, the photosensitive body 1, the charge on which is previously removed by the action of the light from the charge-removing member 25, is next uniformly charged by the charging roller 2.

Furthermore, it may be possible to adopt another structure in which a charging brush, also serving as a contact-type charging member, is brought into contact with the photosensitive body drum, instead of the charging roller 2. Thereafter, the photosensitive body 1, charged in this way is exposed by the radiated light beam 20. The light beam includes the image information and is emitted from the optical scanning apparatus 30. In this way, an electrostatic latent image is formed on the photosensitive body 1.

In the so-called inversed development method, the electrostatic latent image formed on the photosensitive body 1 in the aforementioned way is visualized by attaching the toner on the exposed portion, for instance, to the recording medium in the process of passing to through the developing apparatus 3. The developer (developing agent) 4 composed of non-magnetic toner and magnetic powder carrier are contained in the case of the developing apparatus 3. There are provided a developing sleeve 5 rotating proximate to the photosensitive body 1 and a paddle roller 21 for supplying the developer 4 to the developing sleeve 5 of the developing apparatus 3.

The developer 4 is agitated by the rotation of the paddle roller 21, and the toner is charged by frictional charging at the time of the agitation. The outer circumferential portion of the developing sleeve 5 is made of non-magnetic material rotating on the outside of the fixed magnet. The developer 4 including the charged toner is attached to a portion around the developing sleeve 5 when brushed by the paddle roller 21. The toner is brought into contact with the photosensitive body 1, and the toner is attached to the electrostatic latent image on the photosensitive body by the electrostatic action. In this way, the image is developed and thereby the so-called toner image is formed on the recording medium (visualized).

The amount of the toner used is determined by the difference between the electric potential (voltage) of the image on the photosensitive body 1 and the developing bias voltage applied to the developing roller 2, and the above-mentioned electric potential of the image is determined by the electric potential of the initial charging applied to the charging roller 2 and the light intensity of the light beam 20.

The toner image formed on the photosensitive body 1 rotates together with the photosensitive body 1 and arrives at the transfer portion where the transfer belt 6 is brought into contact with the photosensitive body 1. At this time, the transfer belt 6 is brought into contact with the photosensitive body 1 and thereby rotates together with the body 1 in the same direction and with the same line speed as those of the body 1. A transfer bias voltage of the polarity inverse to that of the toner from the power source is applied to the transfer belt 6.

Each time one job finishes, corresponding to image formation for one sheet of transfer paper, the transfer belt is partly separated from the photosensitive body. The separation time interval extends from the charging of the photosensitive body by the charging roller until the commencement of the exposing and transferring processes.

Moreover, in addition to the example as shown in FIG. 5, there exists another type of the image forming apparatus employing the transfer charger disposed so as to separate (part) it from the photosensitive body 1 instead of the transfer belt 6.

In FIG. 5, the transfer paper S is sent out from a pair of registration rollers 24 timed to perform the transfer operation in the proper transfer position when the above-mentioned toner image arrives at the above-mentioned transfer position. The toner image on the photosensitive body 1 is pinched between the photosensitive body 1 and the transfer belt 6, and the toner image is transferred onto the transfer paper S which is conveyed with the same line speed as that of the photosensitive body 1.

The transfer paper S is conveyed by the transfer belt 6 after transferring the toner image and arrives at the fixing apparatus (not shown in FIG. 5) located at the downstream side of the transfer belt 6. At this time, the toner image transferred onto the transfer paper S is not yet fixed. When the transfer paper S passes through the above-mentioned fixing apparatus, the not-fixed toner image is fixed onto the transfer paper S by the thermal fusing.

The not-transferred residual toner remaining on the photosensitive body 1 moves together with the photosensitive body 1 in the direction of the rotation. The moving toner is intercepted (dummed up) by a cleaning blade 7 disposed (provided) in a cleaning apparatus 10 and collected on the blade 7. The residual toner piled up on the position of the cleaning blade 7 is conveyed onto the withdrawal coil 9 by the cooperative action of Mylar 22 and a withdrawal feather 8 rotating in the counterclockwise direction. The withdrawal coil 9 is a sort of screw conveyer formed by winding wire in a spiral state. The developer is conveyed by the rotation thereof.

The withdrawal coil 9 is partly covered so that the toner can be taken in into the cleaning apparatus 10. The coil 9 is accommodated in the withdrawal tube away from the cleaning apparatus 10 and driven rotatively. The withdrawal tube forms a path from the cleaning apparatus 10 to the developing apparatus 3 and the tube is opened at the upper portion of the paddle roller 21 of the developing apparatus 3. Residual toner drawn into the cleaning apparatus 10 from the photosensitive body 1 is conveyed to the developing apparatus 4 through the aforementioned withdrawal tube by the action of the rotation of the withdrawal coil 9. In such way, the toner is recycled.

The embodiment of the present invention is explained hereinafter, referring to the accompanying drawings.

FIG. 1 is a perspective view conceptionally illustrating an example of an optical scanning apparatus 30 of the present invention. In FIG. 1, two laser diodes LD1 and LD2 are employed as a light source. The photosensitive body 1 can be scanned at the same time with two light beams, and the image exposure can be performed on a photosensitive body 1.

Figure 2:
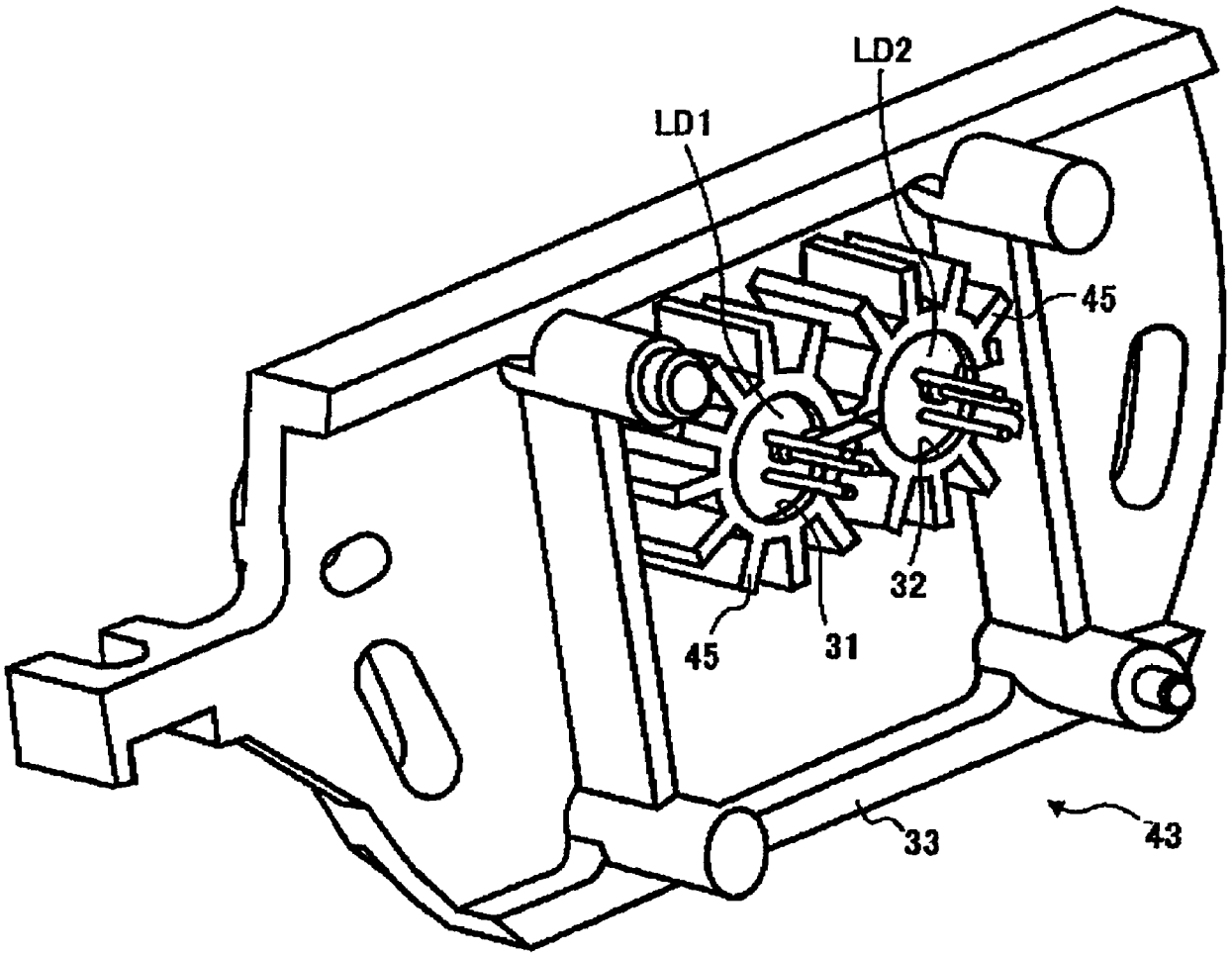
FIG. 2 is a perspective view illustrating the external appearance of an LD unit.
Figure 3:
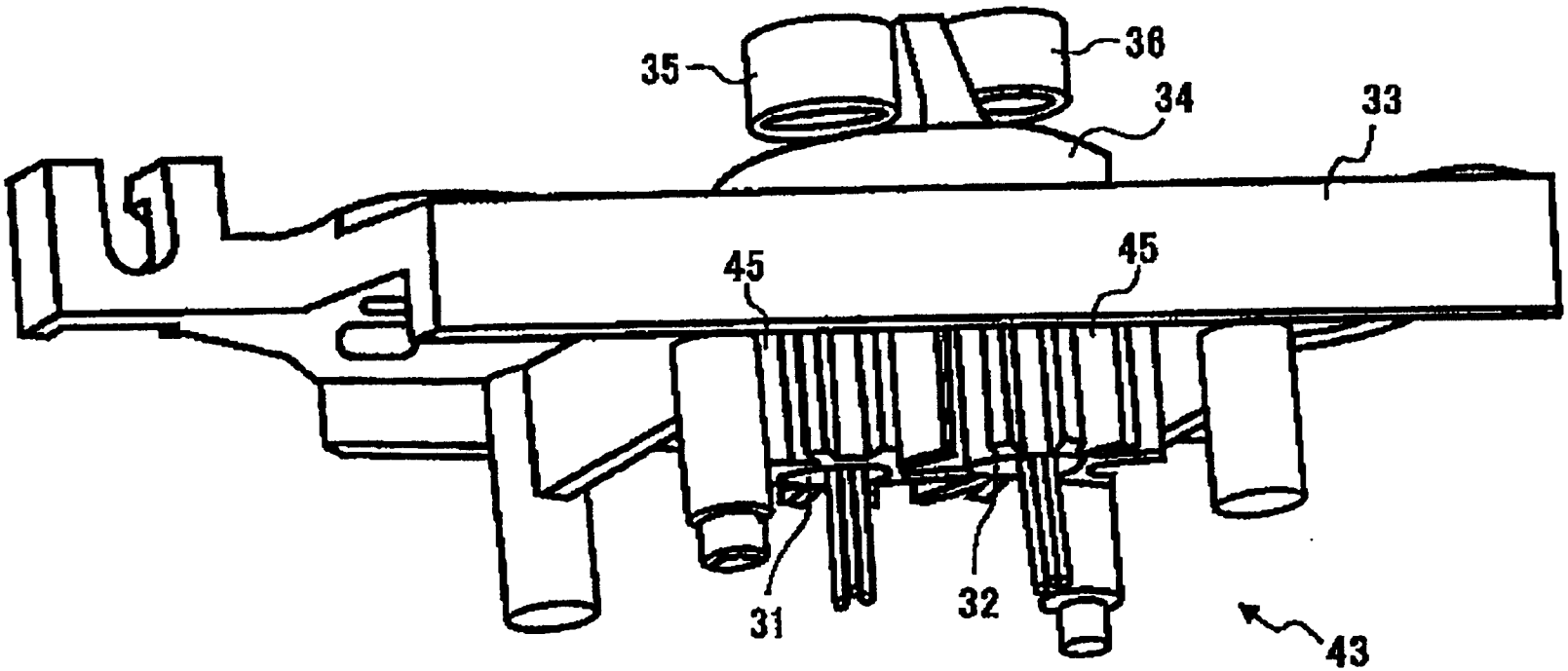
FIG. 3 is another perspective view illustrating the external appearance of the same LD unit.
Figure 4:
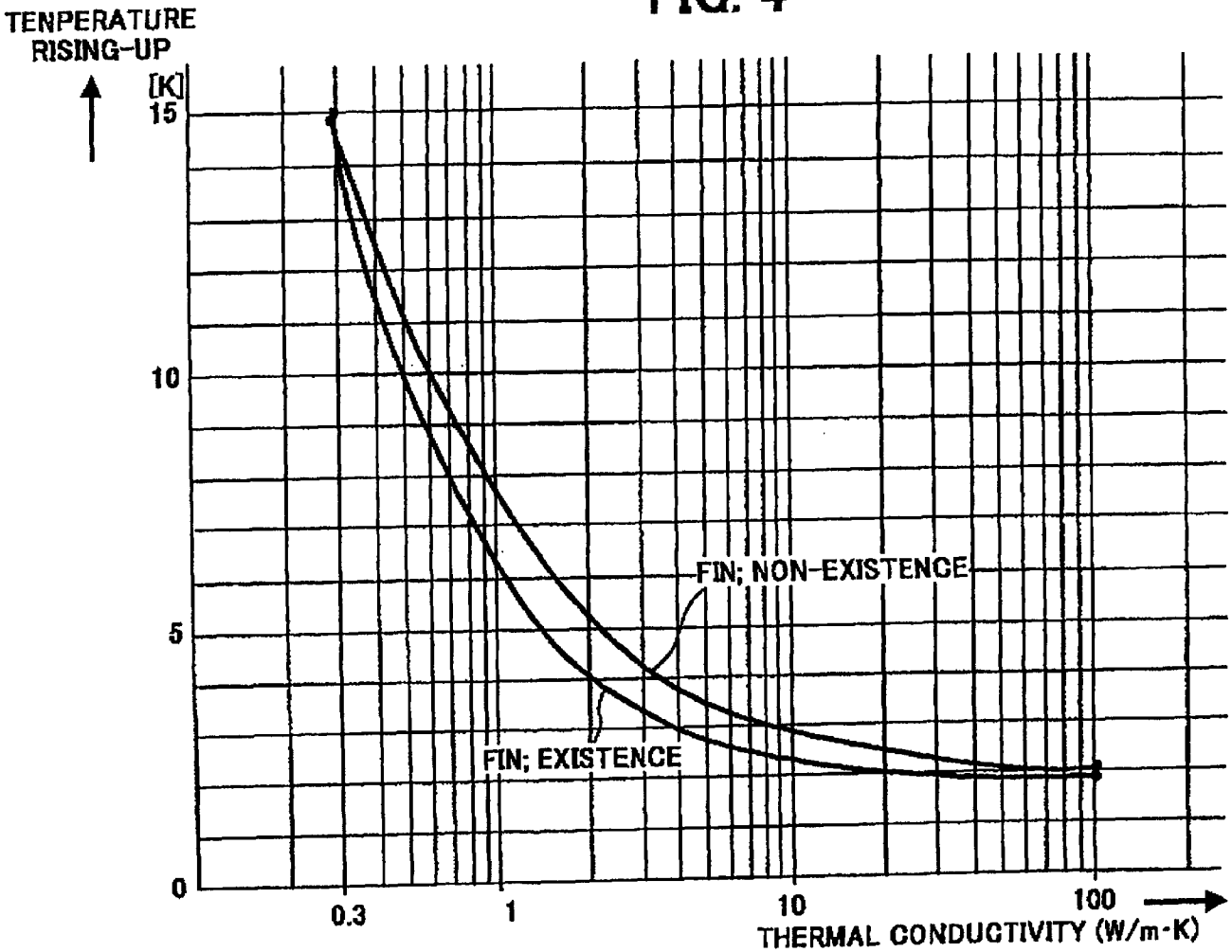
FIG. 4 is a graph showing the relationship between the thermal conductivity of the holding member and the temperature increase of the laser diode.

The two laser diodes LD1 and LD2 are mounted respectively at one end side of respective cylindrical holding members 31 and 32, as shown in FIGS. 2, 3, and 4, and both of a holding members 31 and 32 are installed in holder 33. As shown by the reference numeral 45 in FIG. 2, a number of heat radiating fins 45 are radially projected on the outer circumferential portion of holding members 31 and 32.

Collimator lenses 35 and 36 are located on the holding members 31 and 32, opposite to the respective laser diodes LD1 and LD2. Collimator lenses 35 and 36 are respectively mounted on a support member 34, and support member 34 is fixed to holder 33.

In FIG. 1, holder 33 is mounted on base 38 of the optical scanning apparatus 37. As is well known, an iris plate 44, a cylindrical lens 39, a rotatable polygon mirror 40, an f θ lens 41, and a troidal lens 42, etc. are arranged on the base 38.

The light beams emitted from two laser diodes LD1 and LD2 are respectively shaped (collimated) to parallel lights by the collimator lenses 35 and 36 both arranged respectively opposite laser diodes LD1 and LD2.

The respective light beams shaped by the collimator lenses 35 and 36 are directed to the rotatable polygon mirror 40 serving as the light deflector as the incident light through the cylindrical lens 39 and the iris plate 44, and deflected one-dimensionally in the main scanning direction. The light beams thus deflected are focused, with predetermined positional relationship and with predetermined beam diameter, on the photosensitive body 1, which serves as the recording medium by use of the f θ lens 41 and the troidal lens 42.

In the present embodiment, the two collimator lenses 35 and 36 both provided opposite to the two laser diodes LD1 and LD2 are integrally mounted on the holder 33 through the support member 34 as mentioned before, and the above combination constitutes an LD unit 43.

Those two laser diodes LD1 and LD2 are fittedly fixed by way of the interference fitting into the holes of the cylindrical holding members 31 and 32. Furthermore, the two collimator lenses 35 and 36 are bonded with the adhesive agent to the holder 33 positionally adjusted so as to satisfy the optical properties of the two fittedly inserted laser diodes LD1 and LD2.

In an optical scanning apparatus so constructed, the increase of the temperature on the tube walls of the laser diodes LD1 and LD2 is measured, using the material and the shape of the holding members 31 and 32 as parameters. The measurement of the temperature increase is performed in the following respective cases; (a), (b), and (c):

(a) Ordinary resin of thermal conductivity 0.3 w/m°K is used as the holding member, (b) Glass fiber reinforced unsaturated polyester resin of thermal conductivity 1.0 w/m°K is used as the holding member; and (c) Aluminum of thermal conductivity 100 w/m°K is used as the holding member.

Ordinary resin includes widely and generally used resins, such as: PC resin (polycarbonate), ABS resin (Acrylonitrile-Butadiene-styrene), PS resin (polystyrene), POM resin (polyoxymethylene), PMMA resin (polymethyl methacrylate), polyester resin, PE resin (polyethylene), PVC resin (polyvinyl chloride), epoxy resin, polyvinyl acetate resin, polyamide resin, polyimide resin, PTFE resin (polytetrafloroethylene), and others (phenolic resin, silicone resin, polyvinyl acetal resin, polyvinyl butyral resin, polyurethane resin, cellulose resin, etc.).

In the measurement, the laser diode of the rated electric power 5 mw is used. The temperature increase is measured with input power 3 mw.

The experimental results of comparing the case in which the radiative heat radiating fin 45 exists on the outer circumference of the holding members 31 and 32, as shown in FIGS. 1 through 3, with the case without any heat radiating fin, is shown in FIG. 4. In FIG. 4, the solid line shows the data in the case of employing the holding member without any heat radiating fin, and the dot-and-dash line shows the data in the case of employing the holding member having the heat radiating fin thereon.

As is apparent from FIG. 4, in the case of employing resin of small thermal conductivity as ordinary resin in the above case (a), and in the case of employing metal of large thermal conductivity as aluminum in the above case (c), the temperature of the tube wall of the laser diode is not affected much by the presence or absence of the heat radiating fin. Thermal conductivity is the dominant influence on the temperature of the tube wall of the laser diode.

However, in the above case (a), when the ordinary resin having the conductivity of almost 0.3 w/m°K is employed, the tube wall temperature of the laser diode increases by 15° C. for the environmental (ambient) temperature. Generally, the operating temperature of the optical scanning apparatus is 10–30° C. The internal temperature of the optical scanning apparatus 37 exceeds 45° C. For this reason, when the environmental temperature of the laser diode is 45° C., the temperature of the tube wall of the laser diode becomes equal to at least 60° C. In such a condition, there is a fear that normal performance will be impaired. In addition, both of the light emitting efficiency of the LD and the light emitting wavelength of the same varies considerably. It is probable that such variation optically influences the aimed beam diameter.

A diode is not durable at high temperature. The performance of a laser diode deteriorates at 65° C.–700° C. The wavelength of the laser beam output varies in accordance with variation of the environmental temperature. Specifically, wavelength varies by several nm when the temperature increases by 1 ° C. (1°K), and the focus position is expanded when the temperature increases by 1 ° C. (1°K). The beam diameter on the photosensitive body 1 in the optical scanning apparatus varies when temperature increases, and that results in deterioration of the image quality. Therefore, a temperature increase of the laser diode has to be avoided.

When glass fiber reinforced unsaturated polyester resin having the thermal conductivity 1.0 w/m°K is employed in the above-mentioned case (b), variation in the tube wall temperatures of the laser diodes depends on the presence or absence of a heat radiating fin.

In FIG. 4, although the temperature increase of the laser diode is 8° C. in the absence of the heat radiating fin, the temperature increase is 6° C. with a heat radiating fin. Consequently, even assuming that the environmental temperature of the laser diode is 45° C., the temperature of the tube wall of the laser diode may be equal to only 53° C. (45° C.+8° C.=53° C.) in the case of the absence of the heat radiating fin, while the temperature thereof may become equal to only 51° C. (45° C.+6° C.=51° C.) when the same fin is present. In any case, since the temperature of the laser diode does not reach 65° C., the laser diode is always operates in the safety zone.

As mentioned heretofore, in both presence and absence of a heat radiating fin, considerable heat radiating effect can be obtained in the above-mentioned case (b), compared with the case (a) when employing ordinary resin of thermal conductivity 0.3 w/m°K. In addition, by mounting thereon a heat radiating fin, it is apparent that further heat radiating effect can be obtained.

In the present embodiment, in holding members 31 and 32, glass fiber reinforced unsaturated polyester is employed. In this structure, the thermal conductivity has been improved by filling the unsaturated polyester resin with glass fiber. However, it may be possible to improve the thermal conductivity by filling the same resin with glass fiber or metallic oxide or aluminum. Glass fiber reinforced saturated polyester resin does not contract at all during molding. Therefore, accuracy of size in the molding process is superior. In an optical scanning apparatus, since the positional relationship between the laser diode and the collimator lenses 35 and 36 is important, when employing the aforementioned material, it is possible to obtain a high-accuracy image exposing apparatus having a stable optical properties.

Furthermore, when the resin material of any sort filled with glass fiber or metallic oxide or aluminum is employed as holding members 31 and 32, it is possible to obtain the same effect as that of glass fiber reinforced unsaturated polyester resin.

According to the present invention, regardless of the presence or absence of a heat radiating fin, if the temperature increase is limited to 10° C., even when the internal temperature of the laser diode is 45° C., the laser diode can be kept in the safety zone (within 55° C.). For this reason, resin material of any sort filled with glass fiber or metallic oxide or aluminum or glass fiber reinforced unsaturated polyester resin may be used in the optical scanning apparatus according to the present invention. Those materials as mentioned above possess thermal conductivity of 0.7 w/m°K or more.

Furthermore, any material possessing thermal conductivity of 0.7 w/m°K is suitable.

The structure of the optical scanning apparatus as mentioned heretofore can be applied not only to optical scanning apparatus for use in writing-in of images onto a recording medium such as a photosensitive body, etc., but also to optical scanning apparatus for use in reading-out of an image therefrom. Furthermore, in an image forming apparatus employing the optical scanning apparatus of the embodiment according to the present invention, since influence due to high atmospheric temperature on a laser diode in an optical scanning apparatus can be avoided, it is possible to form an image with high reliability and high quality.

It is apparent from the foregoing description, according to the present invention, that heat emitted from a laser diode itself can be radiated away and, consequently, the temperature increase of the laser diode can be suppressed. Therefore, laser diode deterioration can be prevented, and it is thereby possible to provide an optical scanning apparatus and an image forming apparatus, in which the optical properties of the laser diode are stable. Consequently, optical scanning apparatus and image forming apparatus of high reliability and optical stability can be provided at reduced cost.

According to a second aspect of the invention, a stable (constant) image focusing spot can be obtained on the scanned surface in an image focusing optical system, without the optical variations caused by wavelength changes due to laser diode temperature increases.

According to third and fourth aspects of the invention, material capable of suitable thermal conductivity can be selected easily.

According to a fifth aspect of the invention, laser diode temperature increase can be suppressed by providing one or more heat radiating fins around the laser diode.

Numerous modifications and variations of the present invention are possible in the light of the above teachings. It is therefore to be understood that within the scope of the appended claims, the invention may be practiced otherwise than as specifically described herein.

What is claimed an new and desired to secured by Letters Patent of the United States is:

1. An optical scanning apparatus performing optical scanning, comprising:

a light beam emitting laser diode; and a cylindrical holding member in which said laser diode is fittedly held, said holding member formed of a resin having thermal conductivity equal to or greater than 0.7 w/m°$K_1$ and said holding member including heat radiating fins protecting radially from an outer circumferential portion of said holding member.

2. The optical scanning apparatus according to claim 1, further comprising:

a base portion; and an image focusing system located on the base portion with said holding member.

3. The optical scanning apparatus according to claim 2, wherein said resin includes at least one of a glass fiber filler and a metal oxide filler.

4. The optical scanning apparatus according to claim 2, wherein said holding member further comprises:

a glass fiber reinforced unsaturated polyester resin.

5. The optical scanning apparatus according to claim 1, wherein said resin includes at least one of a glass fiber filler and a metal oxide filler.

6. The optical scanning apparatus according to claim 1, wherein said holding member further comprises:

a glass fiber reinforced unsaturated polyester resin.

7. An optical image forming apparatus comprising:

a charging section;

a developing section;

a transferring section; and an optical scanning apparatus including a light beam emitting laser diode and a cylindrical holding member in which said laser diode is fittedly held, said holding member formed of a resin having a thermal conductivity equal to or greater than 0.7 w/m°K, and said holding member including heat radiating fins projecting radially from an outer circumferential portion of said holding member.

8. The optical image forming apparatus according to claim 7, wherein said holding member further comprises:

a glass fiber reinforced unsaturated polyester resin.

9. An optical scanning apparatus performing optical scanning by use of a light source, comprising:

light emitting means for emitting light beams;

cylindrical holding means for fittedly holding said light emitting means, said holding means formed of a resin having thermal conductivity greater than or equal to 0.7 w/m°K, and said holding means including heat radiating fins projecting radially from an outer circumferential portion of said holding means.

10. The optical scanning apparatus according to claim 9, comprising:

a base portion; and means for focusing an image, said image focusing means and said holding means provided on said base portion.

11. The optical scanning apparatus according to claim 10, wherein said holding means further comprises:

a glass fiber reinforced unsaturated polyester resin.

12. The optical scanning apparatus according to claim 9, wherein said resin includes at least one of a glass fiber filler and a metal oxide filler.

13. The optical scanning apparatus according to claim 10, wherein said holding means further comprises:

a glass fiber reinforced unsaturated polyester resin.

14. An optical image forming apparatus comprising:

a charging section;

a developing section;

a transferring section; and an optical scanning apparatus performing optical scanning by use of a light source, comprising light emitting means for emitting light beams, and cylindrical holding means for fittedly holding said light emitting means, said holding means formed of a resin having thermal conductivity greater than or equal to 0.7 w/m°K, and said holding means including heat radiating fins projecting radially from an outer circumferential portion of said holding means.

15. A method of making an optical scanning apparatus, said apparatus using a light beam emitted from a laser diode source, comprising the steps of:

fittedly inserting said laser diode into a cylindrical holding member, said holding member formed of a resin having a thermal conductivity greater than or equal to 0.7 w/m°K, and said holding member including heat radiating fins projecting radially from an outer circumferential portion of said holding member.

16. The method of making an optical scanning apparatus according to claim 15, further comprising the step of:

mounting a combination of said laser diode, said cylindrical holding member, said heat radiating fin, and an image focusing system on a base portion of said optical scanning apparatus.

17. The method of making an optical scanning apparatus according to claim 15, wherein said resin includes at least one of a glass fiber filler and a metal oxide filler.

18. The method of making an optical scanning apparatus according to claim 15, wherein said holding member comprises ordinary resin.

19. The method of making an optical scanning apparatus according to claim 15, wherein said holding member further comprises:

a glass fiber reinforced unsaturated polyester resin.

20. The method of making an optical scanning apparatus according to claim 15, wherein said holding member further comprises:

an aluminum filled resin.

* * * * *